US005197230A

United States Patent [19]

Simpfendörfer et al.

[11] Patent Number: 5,197,230

[45] Date of Patent: Mar. 30, 1993

[54] FINISH-MACHINING MACHINE

[75] Inventors: Dieter Simpfendörfer, Mühlheim/Main; Alexander Hofsess, Dreieich; Klaus Biebesheimer, Frankfurt, all of Fed. Rep. of Germany

[73] Assignee: Diskus Werke Frankfurt am Main Aktiengesellschaft, Frankfurt, Fed. Rep. of Germany

[21] Appl. No.: 553,727

[22] Filed: Jul. 16, 1990

[30] Foreign Application Priority Data

Jul. 31, 1989 [DE] Fed. Rep. of Germany ..... 3925274
May 9, 1990 [DE] Fed. Rep. of Germany ..... 8915458

[51] Int. Cl.[5] ..... B24B 49/16; B24B 57/02

[52] U.S. Cl. ..... 51/165.77; 51/133; 51/132; 51/118; 51/131.3; 51/292; 51/263; 51/165.87

[58] Field of Search ..... 51/117, 131.3, 118, 51/111 R, 263, 132, 292, 133, 165.77, 165.8, 165.9, 165.87

[56] References Cited

U.S. PATENT DOCUMENTS 2,973,605 3/1961 Carman et al. ..... 51/133
4,315,383 2/1982 Day ..... 51/133

FOREIGN PATENT DOCUMENTS 01577322 1/1970 Fed. Rep. of Germany ..... 51/133
0218300 2/1985 Fed. Rep. of Germany ... 51/165.77
0144958 11/1980 Japan ..... 51/118
0120077 5/1988 Japan ..... 51/133

*Primary Examiner*—Robert A. Rose
*Attorney, Agent, or Firm*—Dvorak and Traub

[57] ABSTRACT

This invention relates to a finish-machining machine for lapping, finish-grinding or polishing. The machine comprises upper and lower annular finishing disks, which are rotatable about a vertical axis and adapted to be separately driven, an inner annular series of pins, which is adapted to be driven, and an outer annular series of pins, which is preferably stationary. Said inner and outer series of pins are provided adjacent to the lower finishing disk. Holders for holding workpieces to be machined are provided between the inner and outer annular series of pins and are capable of performing a planetary movement about said axis and are provided with teeth, which mesh with both of said annular series of pins for imparting said planetary movement to said holders. The machine preferably includes a boom or a portal, in which the upper finishing disk is horizontally movably mounted. A feedback control system is provided for controlling the axial force exerted by the upper finishing disk on the lower finishing disk. A constant pressure under which the cooperating members engage each other during finishing and dressing operations is maintained in that the upper finishing disk, which is preferably mounted by means of a self-aligning bearing, is adapted to be acted upon by pneumatic or hydraulic means for exerting an axial force which is adapted to be detected by force pickups, which are mounted on the underframe of the machine and are directly contacted by or indirectly axially coupled to said lower disk.

20 Claims, 5 Drawing Sheets

SECTION A-B

FINISH-MACHINING MACHINE

BACKGROUND OF THE INVENTION

1. Field of the Invention

This invention relates to a finish-machining machine for lapping, finish-grinding or polishing, comprising upper and lower annular finishing disks, which are rotatable about a vertical axis and adapted to be separately driven, an inner annular series of pins, which is adapted to be driven, and an outer annular series of pins, which is preferably stationary, which inner and outer series of pins are provided adjacent to the lower finishing disk, holders for holding workpieces to be machined, which holders are provided between the inner and outer annular series of pins and are capable of performing a planetary movement about said axis and are provided with teeth, which mesh with both of said annular series of pins for imparting said planetary movement to said holders, which machine preferably includes a boom or a portal, in which the upper finishing disk is horizontally movably mounted, and a feedback control system is provided for controlling the axial force exerted by the upper finishing disk on the lower finishing disk.

2. Description of the Prior Art

Finish-machining machines of the kind described hereinbefore are known in the art.

SUMMARY OF THE INVENTION

It is an object of the invention to provide an automatic control system for causing a constant pressure to be applied between the upper and lower finishing disks during the machining of workpieces and the dressing of the finishing disks and for effecting an automatic vertical adjustment of the finishing disks and an adjustment of optimum speed ratios during the machining of workpieces and the dressing of the finishing disks in accordance with a program which has been stored in the memory of the control system so that reproducible results of the operation will be produced in the accuracy range which is associated with the process and, at the same time, a machine can be designed for a high degree of automation and can be operated by persons having a relatively low skill.

In a finish-machining machine of the kind described first hereinbefore that object is accomplished in accordance with the invention in that the axial force which is indirectly or directly exerted on the lower finishing disk is adapted to be sensed by force pickups provided on the underframe of the machine, force is pneumatically or hydraulically exerted on the upper finishing disk, which is preferably mounted by means of a self-aligning bearing, and the bearing unit for the lower finishing disk is axially supported by force pickups on the underframe of the machine and is held against torsion by preferably thin straps, which extend in a plane that is parallel to the flat top surface of the lower finishing disk and are tensioned between the underframe and the bearing unit. By means of the above-mentioned high-resolution measuring system, which is mounted in the underframe of the machine, a signal that represents the actual value of the axial force is thus generated by strain gauges and is compared with a signal which represents the desired value of the axial force, and the difference signal is the deviation, in dependence on which the pressure within the holding-down unit is so changed that the pressure between the cooperating members remains constant within close predetermined tolerance limits. This is an essential criterion for providing reproducible processing conditions.

The upper finishing disk is axially movable by an adjusting sleeve and is vertically adjustable by pneumatic or hydraulic lifting and holding-down means, which are held against rotation by guide rods. The level of the lower finishing disk is variable by said adjusting sleeve or by a plurality of axially parallel, synchronized power screws, which are interconnected by a crosspiece, so that the level of the top surface of the lower finishing disk can be held constant regardless of the wear.

According to a further feature of the finish-machining machine the infinite adjustment and selective combination of the speeds of the two finishing disks and of the inner annular series of pins and optionally also of the outer annular series of pins disposed adjacent to the lower finishing disk, and, as a result, the planetary movement of the workpiece holders for holding the workpieces to be finished or the dressing rings is program-controlled. As a result, suitable speeds for use during finishing and dressing operations can be selected in accordance with a program which is stored in the memory of the control unit so that optimum relative movements will be performed in dependence on a convenient operator-controlled inputting of recommended data determining the nature of the relative motion of the cooperating members, the relative velocity of the cooperating members and the position of the workpieces in the holders and the size of the dressing rings.

Such an inputting of data will afford the advantage that the reproducibility and quality of the finish resulting from the finishing and dressing operations will not depend on the qualification and empirical knowledge of the operator of the machine.

DETAILED DESCRIPTION OF THE PREFERRED EMBODIMENT

Figure 1:
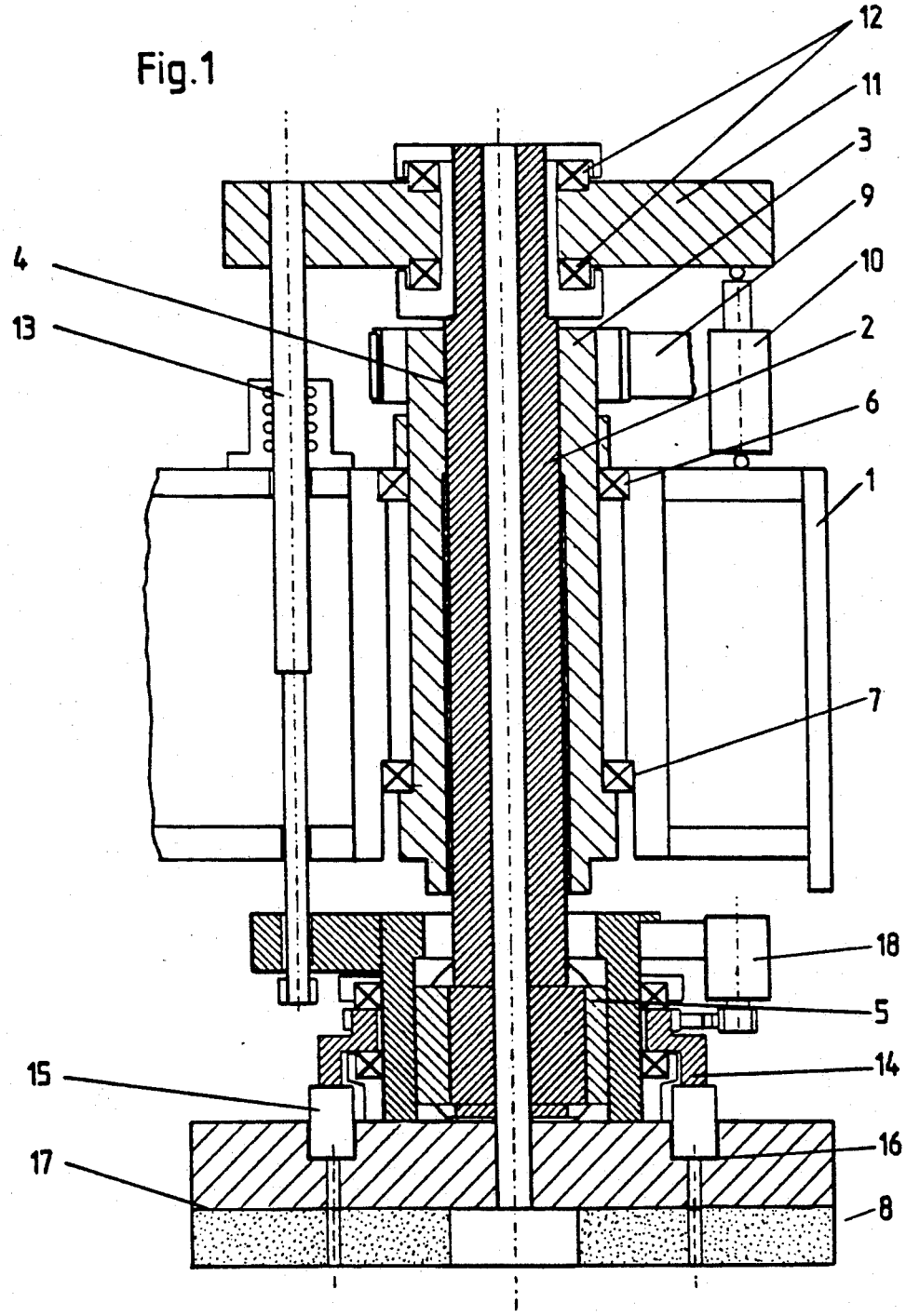
FIG. 1 is a longitudinal sectional view showing the sleeve for axially adjusting the upper finishing disk and the lifting and holding-down means.

A preferred embodiment of a finish-machining machine in accordance with the invention is shown in the drawing and will be described hereinafter.

FIG. 1 shows the top frame 1 of the machine, the axially movable adjusting sleeve 2, which is axially slidably mounted in and positively non-rotatably coupled to a coupling portion 4 of a tubular shaft 3, which is rotatably mounted in the top frame 1 of the machine by means of rolling element bearings 6 and 7. The upper finishing disk 8 is rotatably mounted on the adjusting sleeve 2 by means of a self-aligning bearing 5 and is rotated by a belt drive 9 via the tubular shaft 3. Axial pressure is applied by lifting and holding-down means, which consist of two fluid operable means such as hydraulic cylinders 10 and a crosspiece 11, which is rotatably mounted on and axially coupled to the adjusting sleeve 2 by thrust bearings 12. The torque which is due to the bearing friction is taken up by guide rods 13.

For a lapping operation an abrasive slurry is fed to an annular groove 16, which is formed in the top surface of the upper finishing disk 8 and communicates through angularly spaced apart bores with the working gap between the upper and lower finishing disks 8 and 23. Scraping means 14 comprise scrapers 15, which extend into the annular grooves 16 and distribute the annular slurry in said groove to the bores 17.

Because favorable kinematic conditions often involve a relative low speed of the upper finishing disk and the feeding of the abrasive slurry to the working gap requires a sufficient fast relative movement between the upper finishing disk 8 and the scraping means 14, the latter may be coupled to separate drive means 18 for automatically imparting to the scraping means 14 a rotation in a sense which is opposite to the rotation of the finishing disk 8 when the speed of the latter is below a predetermined limit. The motor 18 for driving the scraping means 14 is so arranged on the top frame 1 of the machine that said motor 18 will not revolve about the axis of the upper finishing disk 8 but will follow the self-aligning movement of the disk 8.

The top frame 1 of the machine may constitute a portal, which is not shown here in more detail, and may be designed in accordance with German Patent Specification 24 42 081 to be horizontally movable with the bearing unit and the upper finishing disk 8 relative to the underframe 19 of the machine.

Figure 2:
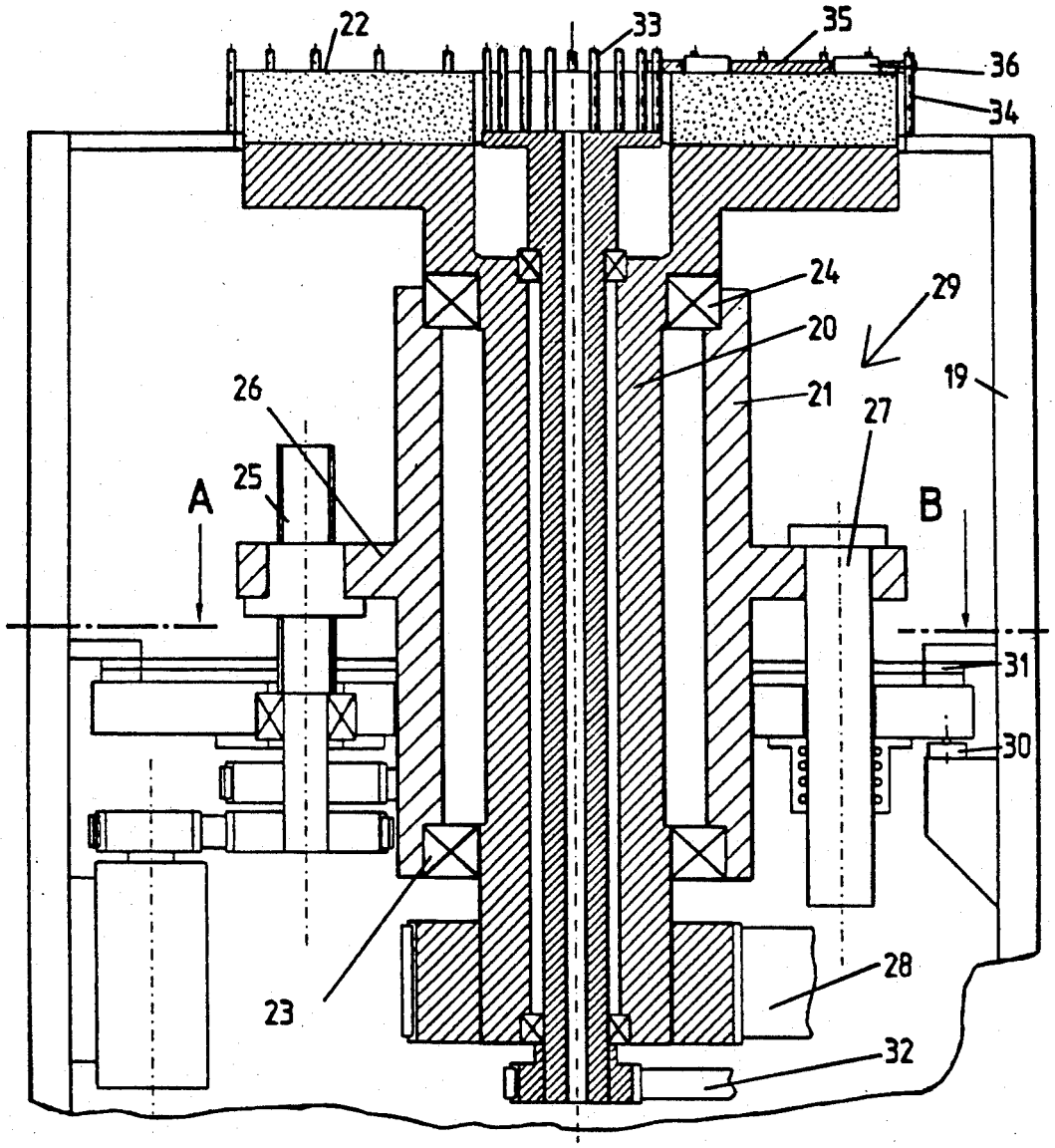
FIG. 2 is a longitudinal sectional view showing the lower finishing disk and the associated means for a vertical adjustment and force pickups.
Figure 3:
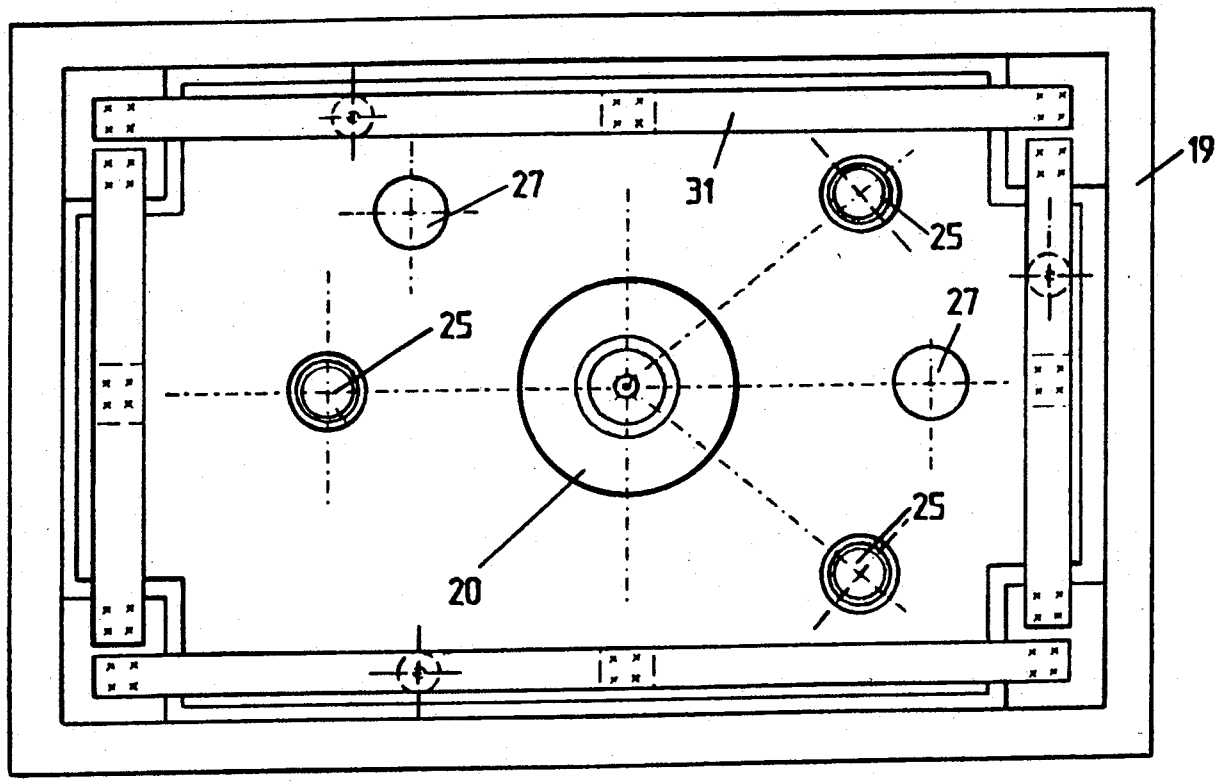
FIG. 3 is a transverse sectional view taken on line A-B in FIG. 2.

FIGS. 2 and 3 show the underframe 19 of the machine and the tubular shaft 20 and the vertically adjustable guide housing 21 mounted in said underframe. The tubular shaft 20 serves to drive the lower finishing disk 22 and is rotatably mounted in the rolling element bearings 23 and 24. The guide housing 21 is vertically adjustably mounted by means of guide rods 27 and is adapted to be vertically adjusted by a plurality of synchronized power screws 25, which are equiangularly spaced around the center line of the guide housing 21 and are connected to the guide housing 21 by a crosspiece 26. The tubular shaft 20 is adapted to be rotated by the belt drive 28.

The fact that the lower finishing disk 22 is mounted for vertical adjustment affords the advantage that a wear of the lower finishing disk which has resulted in a lowering of its top surface can be compensated. The fact that the level of the top surface of the lower finishing disk 22 can be kept substantially constant is an essential requirement for an automatic feeding of workpieces to the machine. Besides, because the level of the lower working disk is adjustable, the operations of measuring the wear of the lower finishing disk and the succeeding operation for finishing the working surfaces of the finishing disks to remove uneven surface portions which would deteriorate the finish which can be provided on the workpieces can be integrated in an automatic sequence and can be performed by a radially disposed measuring and dressing attachment.

The bearing unit 29 for the lower finishing disk 22 is supported by force pickups 30 on the underframe 19 of the machine. Thin straps 31 extend under tension between the underframe 19 and the bearing unit 29 and hold the bearing unit 29 against a rotation in a plane which is parallel to the workpiece plane. The force pickups 30 provided on the underframe 19 serve to maintain the axial force to be exerted by the lifting and holding-down means 10 at a constant value.

FIG. 2 shows also the inner annular series of pins 33, which are driven by a belt drive 32, and the outer annular series of pins 34, which is stationary in the present case, as well as the annular series of holders 35, which are disposed between the inner and outer annular series of pins 33 and 34 and serve to hold workpieces 36. The holders 35 are formed with teeth, which mesh with the inner and outer annular series of pins 33, 34.

Upon a driving of one or both of the annular series of pins 33, 34, a planetary movement about the center line of the machine is imparted to the holders 35 provided with the workpieces 36. In simplifying the illustration FIG. 2, the means for driving the outer annular pins is not shown.

Figure 4:
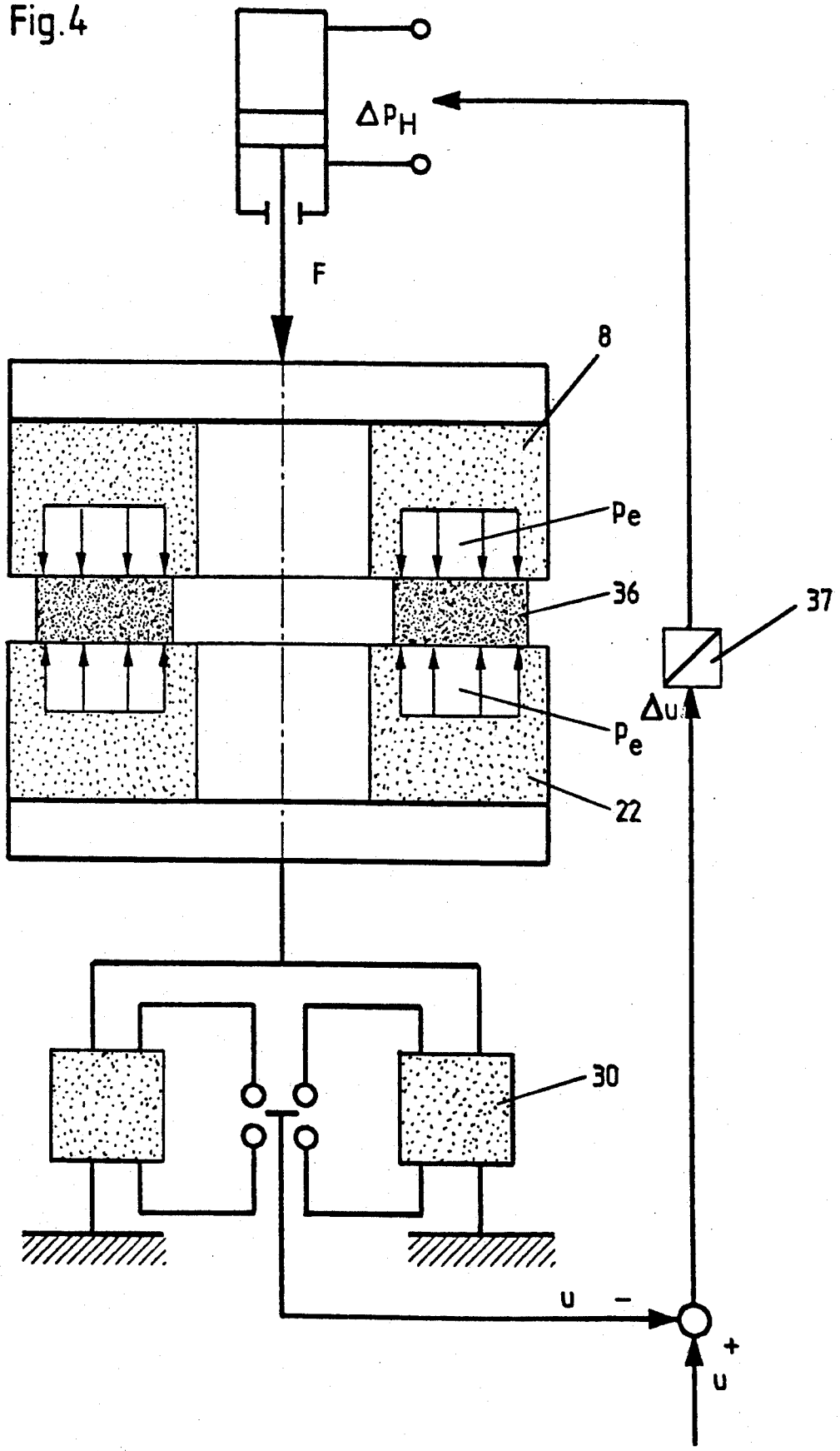
FIG. 4 illustrates the automatic control for maintaining a constant engaging pressure.

The automatic control of the axial force F is diagrammatically illustrated in FIG. 4, which shows the upper and lower finishing disks 8 and 22, which are mounted in the top frame 1 and the underframe 19, respectively, and the workpieces 36 disposed in the working gap between the disks 8 and 22. Force pickups 30 are provided in the underframe 19. The lifting and holding-down means 10 consisting of hydraulic cylinders are mounted in the top frame 1 and are controlled by the signal transducer 37. Owing to the differential pressure $\Delta p_H$ in the cylinders, the hydraulic or pneumatic holding-down means 10 exert on the upper finishing disk 8 an axial force, which has an actual value F and causes a characteristic engaging pressure Pe to be applied between the finishing disks 8 and 22 and the workpieces 36 in dependence on the area in which said disks contact said workpieces. The actual value of the force which is thus exerted on the bearing means for the lower finishing disk 22 is taken up by pressure force pickups 30, which are preferably equiangularly disposed around the axis of the finishing disks in the underframe 19 of the machine.

In dependence on the load applied to the pressure force pickups 30, a voltage signal $u_{ist}$ is generated, which is proportional to the total of the actual force values and which is compared with a voltage signal $u_{soll}$, which is proportional to the desired total force value. The difference signal $\Delta u$ represents the deviation, which causes the differential pressure $\Delta p_H$ in the fluid-operable cylinder of the holding-down unit 10 to be varied so that the contact pressure remains constant within narrow limits.

Compared to known arrangements, the provision of the pressure force pickups 30 in the underframe 19 of the machine affords the advantage that the force that is transmitted through the working gap is correctly detected and the result of the measurement will not adversely be affected by friction losses and by stick-slip actions in the bearings of the upper finishing disk and in the holding-down means.

Figure 5:
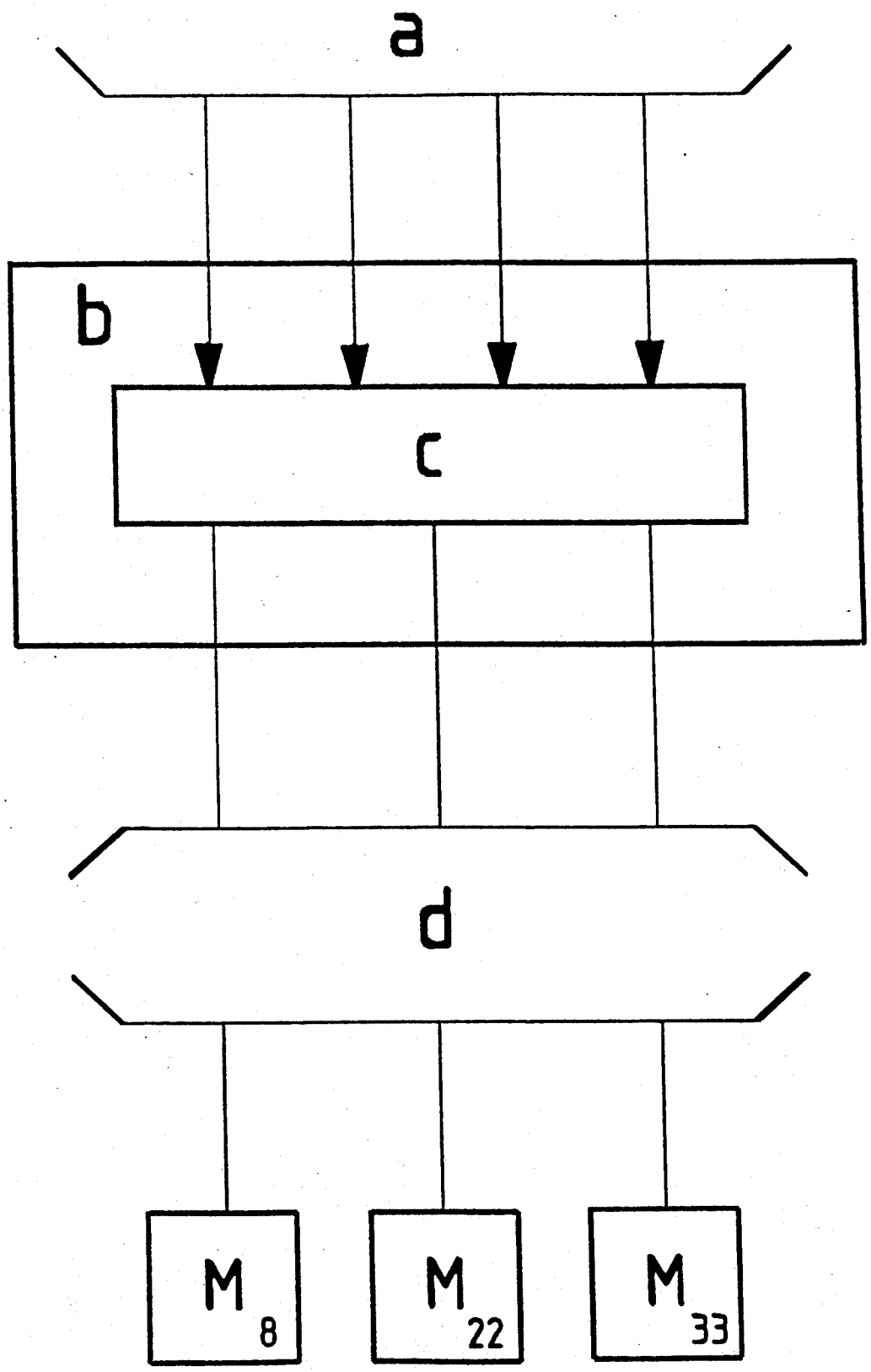
FIG. 5 illustrates the program control for providing optimum relative movements.

FIG. 5 illustrates the program-controlled system for controlling the speed of the drive motors $M_8$, $M_{22}$, and $M_{33}$ for the upper finishing disk 8, the lower finishing disk 22 and, in the present case, the inner annular series of pins 33. In FIG. 5 a: designates the operator-controlled inputting of data,
b: designates the control system,
c: designates the program and
d: designates the signals for controlling the motors for optimum motions.

Because the speeds of all elements to be driven can infinitely be controlled independently of each other, there is an infinite number of speed combinations which can be selected and the motions of the machine can be performed in an infinite number of relationships. Each of said combinations will result in an associated finish of the workpieces. But the system described hereinbefore will not permit of a purposeful optimization of the sequence of motion performed by the machine if the operator has only small experience.

For this reason the control system may be arranged for an operator-controlled inputting of recommended data, which in accordance with a program which is stored in the memory of the control system can be converted without an additional action of the operator to speed control signals delivered to the motors $M_8$ and $M_{22}$ for the two finishing disks 8 and 22, respectively, and to the motor $M_{33}$ for driving the inner annular series of pins 33. Said data can be selected as desired within certain limits and such selection will permit an infinite adjustment and combination of operational parameters in such a manner that optimum motion conditions will be obtained between the cooperating members during a finishing of workpieces and a dressing of the finishing disks.

We claim:

1. In a finish-machining machine comprising an upper annular finishing disk, which is mounted to be rotatable on a vertical axis, a lower annular finishing disk, which is mounted to be rotatable on said axis and spaced below and defines a working gap with said upper disk, separate disk drive means for rotating said upper and lower disks, respectively, about said axis, an inner annular series of pins, which is centered on said axis and extends in said working gap adjacent to said lower disk and mounted to be rotatable about said axis, pin drive means for rotating said inner series of pins about said axis, an outer annular series of pins, which is centered on said axis and extends in said working gap adjacent to said lower disk radially outwardly of said inner series of pins, an annular series of workpiece holders, which are disposed between said inner and outer series of pins in said working gap generally in a plane which is at right angles to said axis and are formed with teeth meshing with said inner and outer series of pins, pin drive means for rotating said inner series of pins about said axis to impart a planetary motion to said workpiece holders, holding-down means for acting on said upper disk to exert on said lower disk an axial force, and a feedback control system for controlling said axial force, the improvement residing in that an underframe is provided, in which said lower disk is mounted for rotation on said axis, and said feedback control system comprises force pickups which are angularly spaced apart about said axis and support said lower disk on said underframe and are adapted to sense said axial force and said holding-down means comprise fluid-operable means for exerting said axial force on said upper disk in dependence on the axial force sensed by said force pickups.

2. The improvement set forth in claim 1 as applied to a lapping machine.

3. The improvement set forth in claim 2, wherein said disk drive means comprise means for rotating said upper disk about said axis in a predetermined sense, said upper disk has a bottom surface defining said working gap and a top surface that is formed with at least one annular groove, which is centered on said axis and is adapted to receive an abrasive slurry and communicates with said working gap through a plurality of angularly spaced apart bores, which open in said bottom surface, scraping means are provided, which are rotatable relative to said upper disk and comprise a plurality of scrapers extending into said at least one annular groove and adapted to distribute said annular slurry in said at least one groove to said bores, speed-sensing means are provided for indicating a rotation of said upper disk at a speed below a predetermined speed, and scraper drive means are provided for rotating said scraping means in the sense which is opposite to said predetermined sense when said speed-sensing means indicate a rotation of said upper disk at a speed below said predetermined speed.

4. The improvement set forth in claim 1 as applied to a finish-grinding machine.

5. The improvement set forth in claim 1 as applied to a polishing machine.

6. The improvement set forth in claim 1 as applied to a finish-machining machine in which said outer annular series of pins is mounted to be stationary.

7. The improvement set forth in claim 1 as applied to a finish-machining machine comprising a portal in which said upper disk is mounted.

8. The improvement set forth in claim 1, wherein said force pickups are indirectly contacted by said lower disk.

9. The improvement set forth in claim 1, wherein said force pickups are indirectly axially engageable by said lower disk.

10. The improvement set forth in claim 1, wherein self-aligning bearing means are provided by which said upper disk is mounted for rotation on said axis.

11. The improviment set forth in claim 1, wherein said fluid-operable means are pneumatic means.

12. The improvement set forth in claim 1, wherein said fluid-operable means are hydraulic means.

13. The improvement set forth in claim 1, wherein said lower disk is mounted to be rotatable on said axis in a bearing unit, which is centered on said axis and is axially supported on said underframe by said force pickups and tensioned straps extending in a plane which is parallel to the above-mentioned plane are connected to said underframe and to said bearing unit to hold said bearing unit against rotation.

14. The improvement set forth in claim 1, wherein a top frame is provided, in which said upper disk is mounted for rotation about said axis, an adjusting sleeve is mounted in said top frame for a movement along said axis and axially couples said fluid-operable means to said upper disk, said fluid-operable means are selectively operable to lift said upper disk by means of said adjusting sleeve and said holding-down means comprise angularly spaced apart guide rods, which are radially spaced from said adjusting sleeve and axially slidably mounted in said top frame and connected to said fluid-operable means to hold them against a rotation about said axis.

15. The improvement set forth in claim 1, wherein said lower disk is mounted in said underframe to be movable along said axis and adjusting means are provided for adjusting said lower disk along said axis.

16. The improvement set forth in claim 15, wherein said adjusting means comprise an adjusting sleeve which is axially coupled to said lower disk and is mounted in said underframe for a movement along said axis.

17. The improvement set forth in claim 15, wherein said adjusting means comprise a plurality of angularly spaced apart, synchronously operable power screws, which are radially spaced from and parallel to said axis and mounted on said underframe, and a crosspiece by which said power screws are axially coupled to said lower disk.

18. The improvement set forth in claim 1, wherein said disk drive means are operable to rotate said upper and lower disks at speeds which are infinitely adjustable, said pin drive means are operable to rotate said inner annular series of pins at an infinitely adjustable speed and program-controlled means are provided for adjusting said speeds independently of each other.

19. The improvement set forth in claim 1, wherein additional pin drive means are provided for selectively rotating said outer series of pins about said axis at an infinitely adjustable speed and said program-controlled means are adapted to adjust said speed of said outer series of pins independently of the others of said speeds.

20. In a lapping machine comprising an upper annular finishing disk, which is mounted to be rotatable on a vertical axis, a lower annular finishing disk, which is mounted to be rotatable on said axis and spaced below and defines a working gap with said upper disk, separate disk drive means for rotating said upper and lower disks, respectively, about said axis, an inner annular series of pins, which is centered on said axis and extends in said working gap adjacent to said lower disk and mounted to be rotatable about said axis, pin drive means for rotating said inner series of pins about said axis, an outer annular series of pins, which is centered on said axis and extends in said working gap adjacent to said lower disk radially outwardly of said inner series of pins, an annular series of workpiece holders, which are disposed between said inner and outer series of pins in said working gap generally in a plane which is at right angles to said axis and are formed with teeth meshing with said inner and outer series of pins, pin drive means for rotating said inner series of pins about said axis to impart a planetary motion to said workpiece holders, holding-down means for acting on said upper disk to exert on said lower disk an axial force, and a feedback control system for controlling said axial force, the improvement residing in that said disk drive means comprise means for rotating said upper disk about said axis in a predetermined sense, said upper disk has a bottom surface defining said working gap and a top surface that is formed with at least one annular groove, which is centered on said axis and is adapted to receive an abrasive slurry and communicates with said working gap through a plurality of angularly spaced apart bores, which open in said bottom surface, scraping means are provided, which are rotatable relative to said upper disk and comprise a plurality of scrapers extending into said at least one annular groove and adapted to distribute said annular slurry in said at least one groove to said bores, speed-sensing means are provided for indicating a rotation of said upper disk at a speed below a predetermined speed, and scraper drive means are provided for rotating said scraping means in the sense which is opposite to said predetermined sense when said speed-sensing means indicate a rotation of said upper disk at a speed below said predetermined speed.

* * * * *